US005111796A

United States Patent [19]

Ogita

[11] Patent Number: 5,111,796

[45] Date of Patent: May 12, 1992

[54] EVAPORATIVE FUEL CONTROL SYSTEM

[75] Inventor: Tamotu Ogita, Susono, Japan

[73] Assignee: Toyota Jidosha Kabushiki Kaisha, Toyota, Japan

[21] Appl. No.: 610,275

[22] Filed: Nov. 7, 1990

[30] Foreign Application Priority Data

Nov. 11, 1989 [JP] Japan ..... 1-292859

[51] Int. Cl.[5] ..... F02M 23/12

[52] U.S. Cl. ..... 123/520; 123/518; 123/458

[58] Field of Search ..... 123/519, 520, 521, 518, 123/516, 458

[56] References Cited

U.S. PATENT DOCUMENTS

| | | | |
|---|---|---|---|
| 3,683,878 | 8/1972 | Rogers | 123/518 |
| 4,116,184 | 9/1978 | Tomita | 123/519 |
| 4,318,383 | 3/1982 | Iritani | 123/520 |
| 4,790,283 | 12/1988 | Uranishi | 123/520 |
| 4,865,000 | 9/1989 | Yajima | 123/520 |
| 4,926,825 | 5/1990 | Ohtaka | 123/520 |

FOREIGN PATENT DOCUMENTS

| | | | |
|---|---|---|---|
| 0021524 | 2/1977 | Japan | 123/519 |
| 0164763 | 12/1980 | Japan | 123/518 |
| 12021 | 3/1982 | Japan . | |
| 55959 | 12/1982 | Japan . | |
| 0128438 | 8/1983 | Japan | 123/520 |
| 192858 | 11/1984 | Japan . | |
| 106971 | 4/1989 | Japan . | |
| 0108843 | 4/1990 | Japan | 123/519 |

*Primary Examiner*—Carl Stuart Miller
*Attorney, Agent, or Firm*—Kenyon & Kenyon

[57] ABSTRACT

An evaporative fuel control system for internal combustion engine which comprises a canister for storing a fuel vapor, a purge passage connecting the canister to an intake manifold, a valve provided in the purge passage, an engine temperature sensor for sensing an engine temperature, a fuel distillation sensor for sensing a fuel distillation characteristic of a fuel within a fuel tank, a first valve control part for controlling a valve opening position of the valve responsive to an engine temperature signal supplied from the engine temperature sensor, and a second valve control part for controlling a time to turn the valve on responsive to a fuel distillation signal supplied from the fuel distillation sensor. According to the present invention, it is possible to suitably retard the time to start fuel purging into the intake manifold when a heavy type fuel is used, and when a light type fuel is used it is possible to suitably advance the time to start the fuel purging to an initial idling time prior to an idling time, thereby ensuring good driveability and reduction of undesired fuel odor from the canister.

8 Claims, 5 Drawing Sheets

EVAPORATIVE FUEL CONTROL SYSTEM

BACKGROUND OF THE INVENTION (1) Field of the Invention

The present invention generally relates to evaporative fuel control systems, and more particularly to an evaporative fuel control system for internal combustion engine which stores a fuel vapor from a fuel system in a canister and transfers the stored fuel vapor to an intake system through a purge passage where a purge control valve is provided.

(2) Description of the Related Art

Conventionally, internal combustion engines, especially a gasoline engine for automobile vehicle using a gasoline fuel, have an evaporative fuel control system mounted therein for preventing a fuel vapor supplied from a fuel tank from escaping to atmosphere. This evaporative fuel control system often uses a conventional charcoal canister to store the fuel vapor supplied from the fuel tank, and the fuel vapor stored in the charcoal canister is sent to an intake manifold of the engine via a purge control valve by means of a vacuum pressure generated during engine operation. The engine operation usually when the engine is at low temperatures is not yet stable, and, in such a condition of the engine, a fuel purging by the evaporative fuel control system to make the intake manifold take in the fuel vapor from a purge passage leading to the intake manifold may often worsen driveability. There are several conventional techniques which have been proposed to stop the fuel purging operation of the evaporative fuel control system when the engine is in an unstable state as described above. These techniques are disclosed, for example, in Japanese Published Patent Application No. 57-12021, Japanese Laid-Open Utility Model Application No. 57-55959 and Japanese Laid-Open Patent Application No. 59-192858.

Generally, fuel which is commercially available for use in internal combustion engines, especially in an automobile gasoline engine, may be classified by the distillation characteristic into some categories, for example, a light type fuel, a heavy type fuel and the others. Therefore, in the following description, consider a criterion for classifying these fuels into such categories depending on whether more than 50% of the fuel evaporates at 100 deg. C. The light type fuel meets this criterion and the heavy type fuel does not meet it. The light type fuel generally contains components having low boiling points below 100 deg. C in a greater percent than that of the remainder having high boiling points higher than 100 deg. C. In contrast, the heavy type fuel contains components having high boiling points above 100 deg. C in a greater percent than that of the remainder having low boiling points not higher than 100 deg. C. Especially in a case of an automotive gasoline engine, some different types of fuel having different distillation characteristics may be used for the same engine, sometimes the light type fuel being used and in the other the heavy type fuel being used. When the heavy type fuel is used, the fuel of this type generally is not easy to evaporate when compared with the case of the light type fuel, and there is a greater part of the fuel that is supplied by a fuel injection valve but sticks to an intake manifold wall.

Fuel vapor which is actually introduced into a combustion chamber of the engine is made up primarily of a first part being injected by the fuel injection valve but not sticking to the intake manifold wall. a second part sticking to the intake manifold wall and being in a liquid state, and a third part being on the intake manifold wall in a liquid state but being turned from the liquid state into a vapor state. In the case of the heavy type fuel that has a part sticking to the intake manifold wall in a greater percent, the composition of the fuel having these parts varies greatly for each cycle of engine operation, and a constant amount of each part of the fuel cannot be introduced into the combustion chamber for engine operating cycles, thereby causing a fluctuation of air/fuel ratio within the combustion chamber and an instability of engine operation which are more appreciable than in the case of the light type fuel.

However, a conventional evaporative fuel control system usually stops the fuel purging immediately when it finds that the engine operates unstably, regardless of what kind of fuel is used for the engine. And, immediately when the conventional evaporative fuel system finds the engine in a stable operating state, the system starts the fuel purging at a fixed time with respect to the engine operating cycles, regardless of what distillation characteristic the fuel shows. Therefore, in a case in which the heavy type fuel is used, the fuel purging is started at an excessively early time when the engine operation is not yet stable, causing poor driveability. And, in a case in which the light type fuel is used, the starting of fuel purging delays excessively and too much fuel vapor is adsorbed in the canister, causing poor driveability and increasing undesired fuel odor from a canister opening.

SUMMARY OF THE INVENTION

Accordingly, it is a general object of the present invention to provide a novel and useful evaporative fuel control system in which the above described problems are eliminated.

Another and more specific object of the present invention is to provide an evaporative fuel control system which comprises a canister for storing a fuel vapor supplied from a fuel tank, a purge passage provided between the canister and an intake manifold of an internal combustion engine, a valve provided at an intermediate portion of the purge passage for regulating a flow of a fuel vapor from the canister into the intake manifold in accordance with an operating condition of the internal combustion engine, an engine temperature sensing part for sensing an engine temperature of the internal combustion engine, a fuel distillation sensing part for obtaining a fuel distillation characteristic of a fuel within the fuel tank, a first valve control part, responsive to the engine temperature supplied from the engine temperature sensing part, for adjusting a valve position of the valve to control the flow of the fuel vapor from the canister into the intake manifold, and a second valve control part, responsive to the fuel distillation characteristic supplied from the fuel distillation sensing part, for adjusting a time of turning the valve ON at which a supply of the fuel vapor from the valve to the intake manifold is started. According to the present invention, it is possible to suitably retard the time to start fuel purging to a later time after an idling time when the heavy type fuel is used, and when the light type fuel is used it is possible to suitably advance the starting time of fuel purging to an initial idling time prior to the idling time, thereby ensuring good driveability and elimination of undesired fuel odor from a canister opening regardless of which type of the fuel is used.

Other objects and further features of the present invention will become apparent from the following detailed description when read in conjunction with the accompanying drawings.

DESCRIPTION OF THE PREFERRED EMBODIMENT

Figure 1:
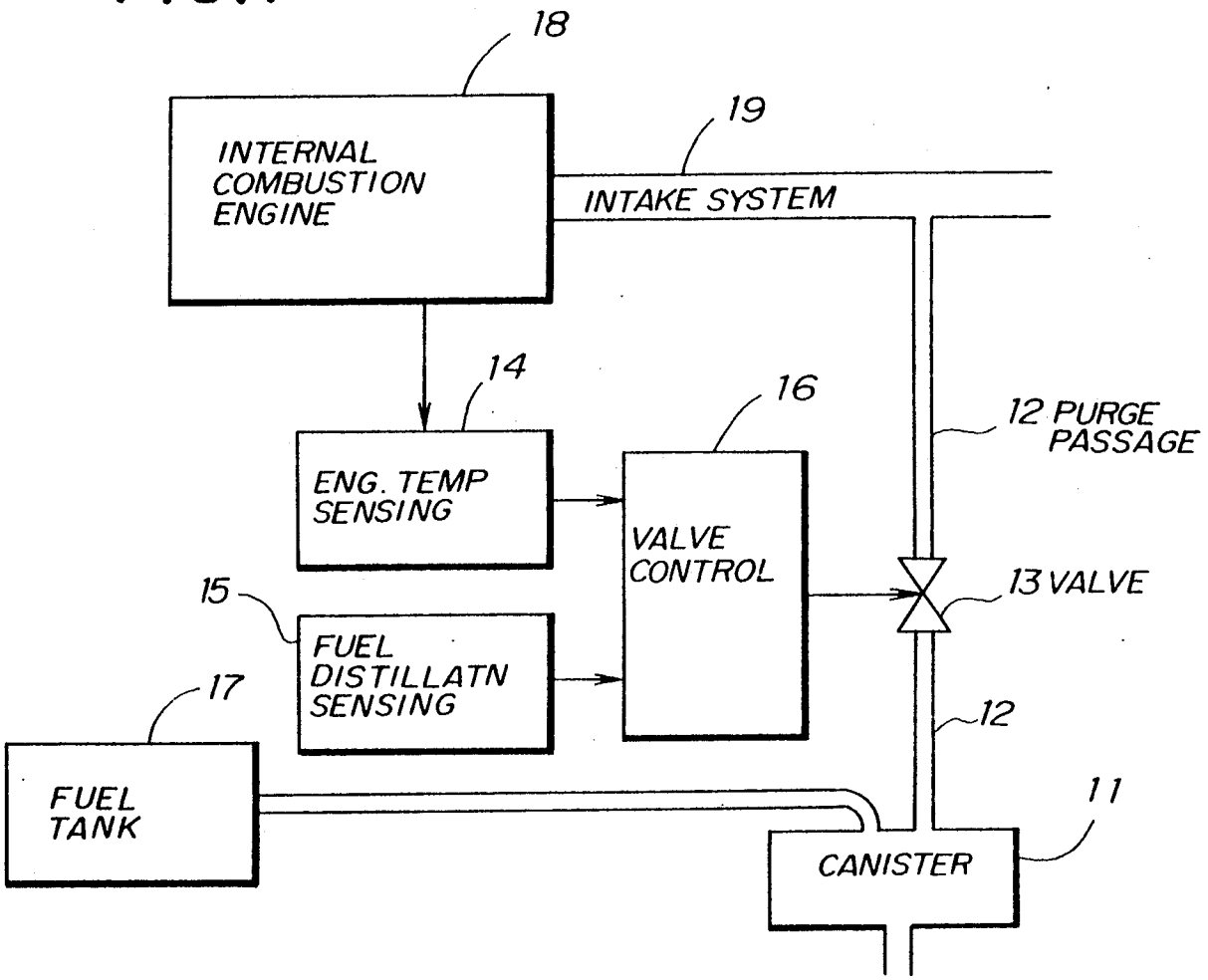
FIG. 1 is a block diagram for explaining the construction of an evaporative fuel control system according to the present invention.

First, a description will be given of the construction of an evaporative fuel control system according to the present invention, with reference to FIG. 1. This evaporative fuel control system generally has a canister 11, a purge passage 12, a valve 13, an engine temperature sensing part 14, a fuel distillation sensing part 15 and a valve control part 16. The canister 11 stores a fuel vapor supplied from a fuel tank 17. The purge passage 12 communicates the canister 11 with an intake system 19 of an internal combustion engine 18, and at an intermediate portion of the purge passage 12 the valve 13 is provided. This valve 13 has a valve opening position which is automatically adjusted by the valve control part 16 in accordance with an engine operating state. The fuel vapor stored in the canister 11 is sent to the intake system 19 via the purge passage 12 when the valve 13 is turned ON and placed at an open position. The engine temperature sensing part 14 obtains an engine temperature T of the internal combustion engine 18. The fuel distillation sensing part 15 obtains a distillation characteristic of a fuel within the fuel tank 17. And the valve control part 16 adjusts the valve 13 at a closed position when the engine temperature t obtained by the engine temperature sensing part 14 is lower than a predetermined value t1, and controls the ON/OFF timing of the valve 13 by changing the predetermined value t1 when a fuel different from the heavy type fuel (hereinafter, referred to as a non-heavy type fuel) is used into another engine temperature t2 for the case of the heavy type fuel being used in accordance with the fuel distillation characteristic obtained by the fuel distillation sensing part 15, the engine temperature t2 when the heavy type fuel is used being higher than the predetermined value t1 when a non-heavy type fuel is used.

Next, a description will be given of the operation of the evaporative fuel control system shown in FIG. 1. Conventionally, when a non-heavy type fuel, especially the light type fuel, is used and the starting of fuel purging is made after an idling of the engine is completed, a large quantity of fuel vapor is quickly supplied to the intake system 19 immediately after the fuel purging is started because a fuel temperature is high at this stage and a large quantity of fuel is already evaporated. As the result, the air/fuel ratio fluctuates, causing poor driveability immediately after the start of fuel purging, although the engine operates stably due to the idling operation. However, it is verified from experimental results that, for achieving good combustion in an internal combustion engine when a non-heavy type fuel is used, the starting time of fuel purging should be changed to an earlier time prior to the idling of the engine so that a supply of fuel vapor, even in a small amount, to the intake system is started at an earlier time. And, because of a demand for an engine design having a smaller size, the capacity of the canister 11 is limited, and an increase of undesired gasoline odor from a canister hole due to an excessively great amount of fuel vapor stored in the canister 11 should be avoided. From these reasons, it is desired to start the fuel purging as early as possible in engine operation stages especially when the light type fuel is used.

In the meantime, in a case in which the heavy type fuel is used, the start of fuel purging at a time of an initial idling prior to the idling stage causes a great fluctuation of air fuel ratio and worsens driveability, because the engine is not yet stable at this stage. And, the heavy type fuel is not easy to evaporate, and a relatively small amount of fuel vapor is adsorbed in the canister at the initial idling stage, when compared with the case of a non-heavy type fuel being used. Therefore, the amount of fuel vapor that is adsorbed in the canister 11 at this stage is not so great, and it is unnecessary to advance the start timing of fuel purging to the initial idling stage as in the case of a non-heavy type fuel being used.

According to the present invention, when the fuel distillation sensing part 15 finds that the fuel within the fuel tank 17 is the heavy type fuel, the valve control part 16 changes a predetermined engine temperature t0 at which the valve 13 is turned ON to the engine temperature t2, the engine temperature t2 being higher than the engine temperature t1 when a non-heavy type fuel is used. This allows the start timing of fuel purging to retard from that when a non-heavy type fuel is used, so that the fuel purging when the heavy type fuel is used is started after the engine operation becomes stable. And, when a non-heavy type fuel is used, the engine temperature t1 is used for turning the valve 13 ON to transfer the fuel vapor to the intake system 19, and it is possible to start the fuel purging at the initial idling stage that is early enough to prevent the fluctuation of air fuel ratio and avoid the poor driveability.

Figure 2:
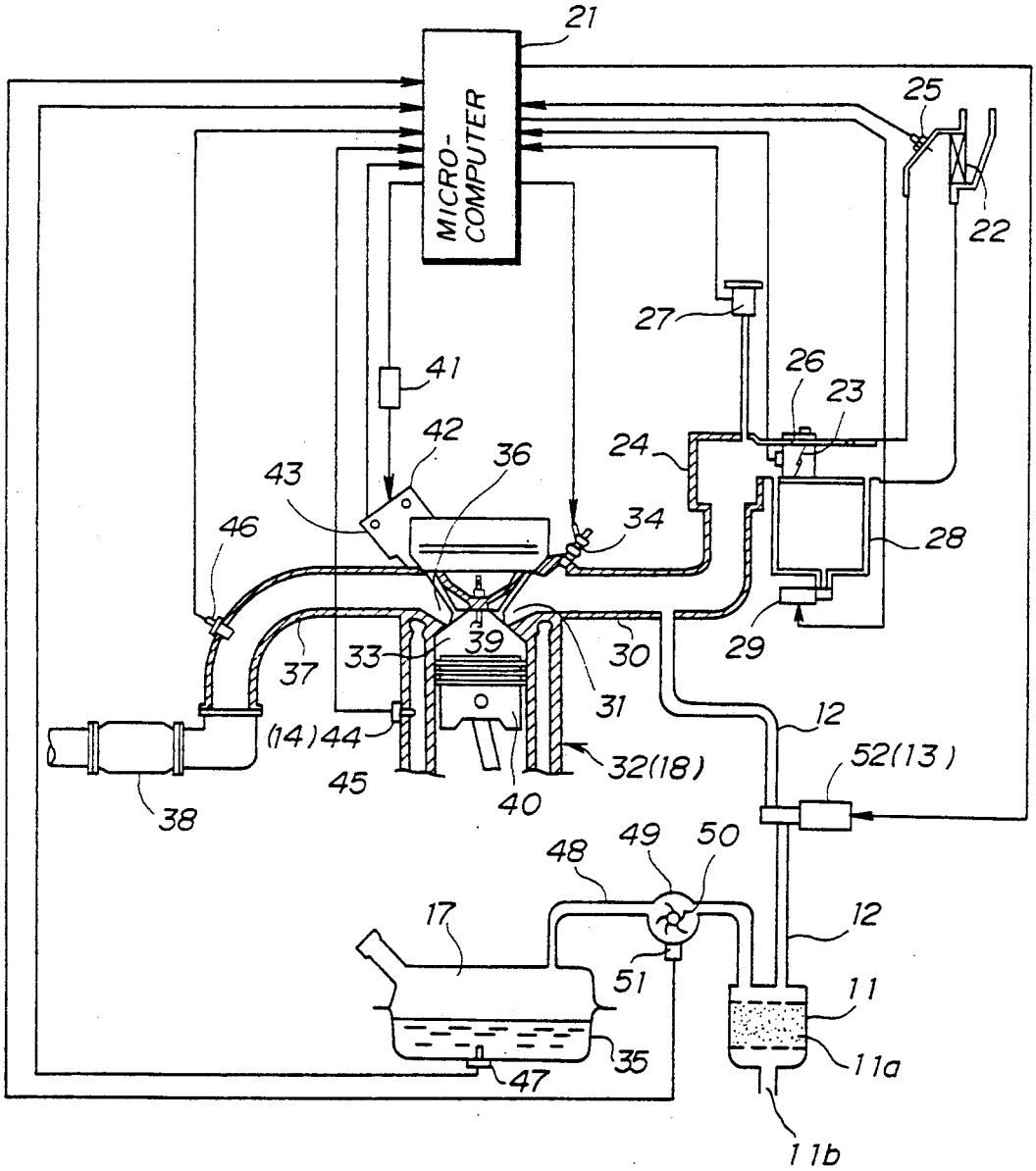
FIG. 2 is a view showing an embodiment of the evaporative fuel control system according to the present invention.

FIG. 2 shows an embodiment of the evaporative fuel control system according to the present invention which is applied to a 4-cylinder 4-cycle spark ignition engine. In FIG. 2, those parts which are the same as those corresponding parts in FIG. 1 are designated by the same reference numerals, and a description thereof will be omitted.

As shown in FIG. 2, a surge tank 24 is provided on a downstream side of an air cleaner 22 and a throttle valve 23 is provided between the air cleaner 22 and the surge tank 24. In the vicinity of the air cleaner 22, an air temperature sensor (ATS) 25 is provided for sensing a temperature of intake air, and the throttle valve 23 is provided with an idle switch (IDL SW) 26 which is turned ON when the throttle valve 23 is in a closed position. The surge tank 24 is provided with an air pressure sensor (APS) 27 for sensing a pressure of intake air, and this air pressure sensor 27 may be, for example, a diaphragm type pressure sensor. At a side portion of a passage within which the throttle valve 23 is placed, a bypass passage 28 is provided so as to communicate between the upstream and downstream sides of the throttle valve 23, and at an intermediate portion of the bypass passage 28 an idle speed control valve (ISCV) 29 is provided. This idle speed control valve 29 has a valve opening position that is automatically adjusted by controlling an electrical current across a solenoid within the ISCV 29, allowing an idling speed of the engine to be adjusted to a target speed. In this idle speed control valve 29, a duty factor of an electric current across the solenoid in the ISCV 29 is controlled for obtaining a proper valve opening position of the ISCV 29 so that a flow rate of air passing through the bypass passage 28 is adjusted appropriately, thereby setting the engine idling speed to the target speed.

The surge tank 24 communicates with a combustion chamber 33 of an engine 32, which corresponds to the internal combustion engine 18 shown in FIG. 1, through an intake manifold 30, corresponding to the intake system 19 shown in FIG. 1, and through an intake port 31. A fuel injection valve (FIV) 34 is provided for each of cylinders of the engine 32, the fuel injection valve partially projecting inward within the intake manifold 30. By means of this fuel injection valve 34, a fuel 35 within the fuel tank !7 is injected into the intake manifold 30 so that air and fuel are mixed therein. And, the combustion chamber 33 communicates with an exhaust manifold 37 via an exhaust port 36, the exhaust manifold 37 leading to a catalytic converter 38. A spark plug 39 is provided on the engine 32, the spark plug 39 partially projecting inward within the combustion chamber 33, and a piston 40 is provided within each of the cylinders of the engine 32, the piston 40 during operation moving up and down. An igniter (IG) 41 generates a high voltage, and this high voltage is supplied to the spark plug 39 for each cylinder of the engine 32 by a distributor 42. A rotation angle sensor (RAS) 43 is provided at the distributor 42 for sensing a rotation angle of a distributor shaft, and this rotation angle sensor 43 supplies an engine speed signal indicative of engine speed to a microcomputer 21 periodically at time intervals of 30 deg. CA. A water temperature sensor (WTS) 44 which constitutes the engine temperature sensing part 14 shown in FIG. 1 is provided at the engine 32 for sensing a temperature of cooling water used for cooling the engine, the water temperature sensor 44 going through a wall of an engine block 45 and partially projecting inward within a water jacket of the engine 32, the water temperature sensor 44 supplies a signal (THW) indicative of a temperature of engine cooling water to the microcomputer 21. Further, an oxygen sensor (OS) 46 is provided at the exhaust manifold 37 for sensing an oxygen concentration of exhaust emission gas from the engine 32 before entering the catalytic converter 38, the oxygen sensor 46 partially projecting inward within the exhaust manifold 37.

At a bottom portion of the fuel tank 17, a fuel temperature sensor (FTS) 47 is provided for measuring a temperature of the fuel 35 within the fuel tank 17. At a top portion of the fuel tank 17 a vapor passage 48 is provided, and this vapor passage 48 communicates with the canister 11 through a vapor flow meter 49 in which a rotation part 50 is provided, the rotation part 50 rotating at a rate in accordance with the flow rate of fuel vapor across the vapor flow meter 49, a signal rotor (not shown) being mounted on the rotation part 50. And a vapor flow rate sensor 51 is provided on a housing of the the vapor flow meter 49 for supplying an output signal to the microcomputer 21, this output signal changing from a low level to a high level when the signal rotor of the rotation part 50 in the vapor flow meter 49 crosses the vapor flow rate sensor 51, and when the signal rotor goes apart from the vapor flow rate sensor 51 the output signal returns back to the low level. Therefore, the output signal changes from the low level to the high level once per revolution of the rotation part 50 of the vapor flow meter 49. While the flow rate of fuel vapor supplied from the fuel tank 17 is thus measured by the vapor flow meter 49, the fuel vapor enters the canister 11.

The canister 11 contains active carbon **11*a* for adsorbing fuel vapor, and at a bottom portion of the canister 11 a canister opening 11*b* is provided. The canister 11 communicates with the intake manifold 30 through the purge passage 12. A vacuum pressure in the intake manifold 30 does not act directly on the fuel tank 17 because an orifice (not shown) is provided at a portion of the purge passage 12. A purge control valve (PCV) 52 that constitutes the above described valve 13 shown in FIG. 1 is provided at an intermediate portion of the purge passage 12. This purge control valve 52 has a valve opening position that is automatically adjusted by controlling an electric current across a solenoid within the PCV 52, thereby allowing the flow rate of fuel vapor through the purge passage 12 to be adjusted. In this purge control valve 52, a duty factor of an electric current across the solenoid in the PCV 52 is controlled for obtaining a properly adjusted valve opening angle of the PCV 52 so that the flow rate of fuel vapor through the purge passage 12 is adjusted appropriately, thereby setting the flow rate of fuel vapor to a target flow rate. The purge control valve 52 is adjusted to a closed position when the temperature of the engine cooling water is not greater than a predetermined value t0, so as to shut off the flow of the fuel vapor into the intake manifold 30. Accordingly, a fuel purging when the engine 32** operates unstably is inhibited.

Fuel vapor supplied from the fuel tank 17 to the canister 11 via the vapor passage 48 and the vapor flow meter 49 is adsorbed by the active carbon **11*a* within the canister 11, preventing the fuel vapor from escaping to atmosphere. During engine operation, air is introduced into the canister 11 from the canister opening 11*b* by a vacuum pressure within the intake manifold 30, so that the fuel vapor is removed from the active carbon 11*a* and is introduced into the intake manifold 30 via the purge passage 12 and the purge control valve 52. As the result, the active carbon 11*a* within the canister 11** is reactivated due to the removal of the fuel vapor and ready for a next adsorption.

Figure 3:
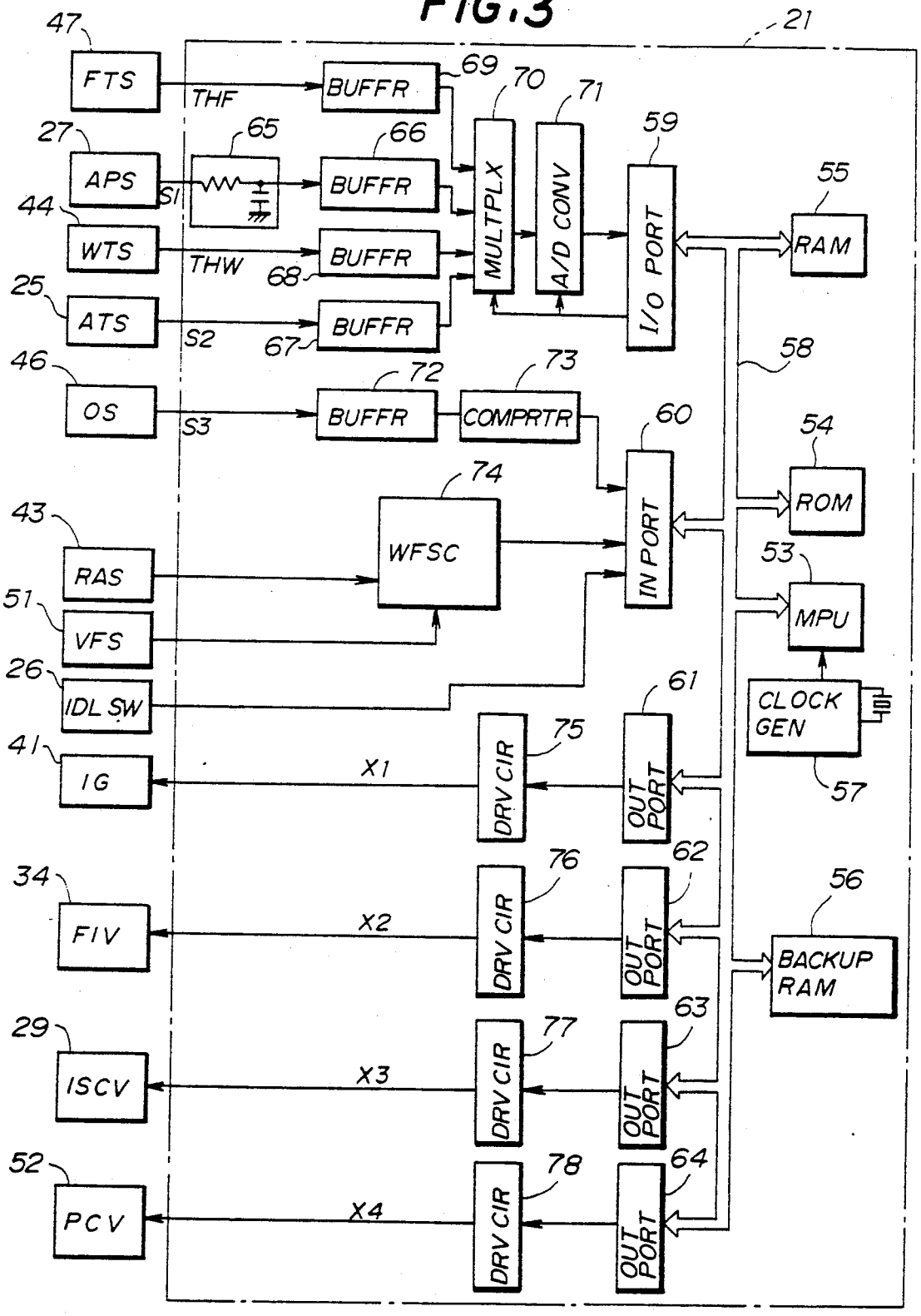
FIG. 3 is a block chart for explaining the construction of a microcomputer shown in FIG. 2.

FIG. 3 shows the construction of the microcomputer 21 which controls the operation of the evaporative fuel control system according to the present invention. In FIG. 3, those parts which are the same as those corresponding parts in FIG. 2 are designated by the same reference numerals, and a description thereof will be omitted. As shown in FIG. 3, the microcomputer 21 generally has a microprocessor unit (MPU) 53, a read only memory (ROM) 54 in which processing software is stored, a random access memory (RAM) 55 which is used for a work area, a backup random access memory (BACKUP RAM) 56 in which a data item is stored continuously even after the engine operation is stopped, a clock generator (CLK GEN) 57 which supplies a master clock signal to the MPU 53, a bidirectional bus line 58 which is coupled to the above described units 53 to 57, and an input/output port (I/0 PORT) 59, an input port (IN PORT) 60 and output ports (OUT PORTS) 61 to 64 which are coupled to the above described units 53 to 57 via the bidirectional bus line 58.

The microcomputer 21 further includes buffers 66 through 69, a multiplexer 70 to which several analog signals are supplied from the above described sensors through the buffers 66 through 69 respectively, and an analog-to-digital (A/D) converter 71. An air pressure signal S1 indicative of a pressure of intake air is supplied from the air pressure sensor 27 to the multiplexer 70 through a filter circuit 65 and the buffer 66 which are connected in series to each other. This filter circuit 65 is provided for removing a pulsating component from the pressure signal outputted from the pressure sensor 27. An air temperature signal S2 indicative of a temperature of intake air is supplied from the air temperature sensor 25 to the multiplexer 70 through the buffer 67. A water temperature signal THW indicative of a temperature of engine cooling water is supplied from the water temperature sensor 44 to the multiplexer 70 through the buffer 68. A fuel temperature signal THF indicative of a temperature of fuel within the fuel tank is supplied from the fuel temperature sensor 47 to the multiplexer 70 through the buffer 69. Under control of the MPU 53, the multiplexer 70 selectively outputs each of these signals in prescribed order, and each of the signals is converted into a digital signal by the A/D converter 71, then information represented by this digital signal supplied from the A/D converter 71 is stored in the RAM 55 through the I/0 port 59. Accordingly, the MPU 53, the multiplexer 70, the A/D converter 71 and the I/0 port 59 constitute a sampling part for sampling at prescribed time intervals the signals S1, S2, THF and THW which are supplied from the above described sensors, respectively.

In addition, the microcomputer 21 further includes a buffer 72, a comparator 73 and a waveform shaping circuit (WFSC) 74. An oxygen signal S3 indicative of an oxygen concentration of exhaust gas is supplied from the oxygen sensor 46 to the comparator 73 through the buffer 72. A waveform of the oxygen signal S3 is shaped by the comparator 73, and the resultant signal is supplied to the input port 60. And, a waveform of signals supplied from the rotation angle sensor 43 and from the vapor flow rate sensor 51 is shaped by the waveform shaping circuit 74, and the resultant signal is supplied to the input port 60. Furthermore, a signal from the idle switch 26 is supplied to the input port 60 through a buffer (not shown). The microcomputer 21 further includes drive circuits 75 through 78. An output signal Xl from the output port 61 is supplied to the igniter 41 through the drive circuit 75. An output signal X2 from the output port 62 is supplied to the fuel injection valve 34 through the drive circuit 76. An output signal X3 from the output port 63 is supplied to the idle speed control valve 29 through the drive circuit 77. An output signal from the output port 64 is supplied to the purge control valve 53 through the drive circuit 78. Hence, the microcomputer 21 and the vapor flow rate sensor 51 constitute the fuel distillation sensing part 15 as shown in FIG. 1, and the processing software within the ROM 54 achieves the above described function of the valve control part 16 indicated in FIG. 1.

Figure 4:
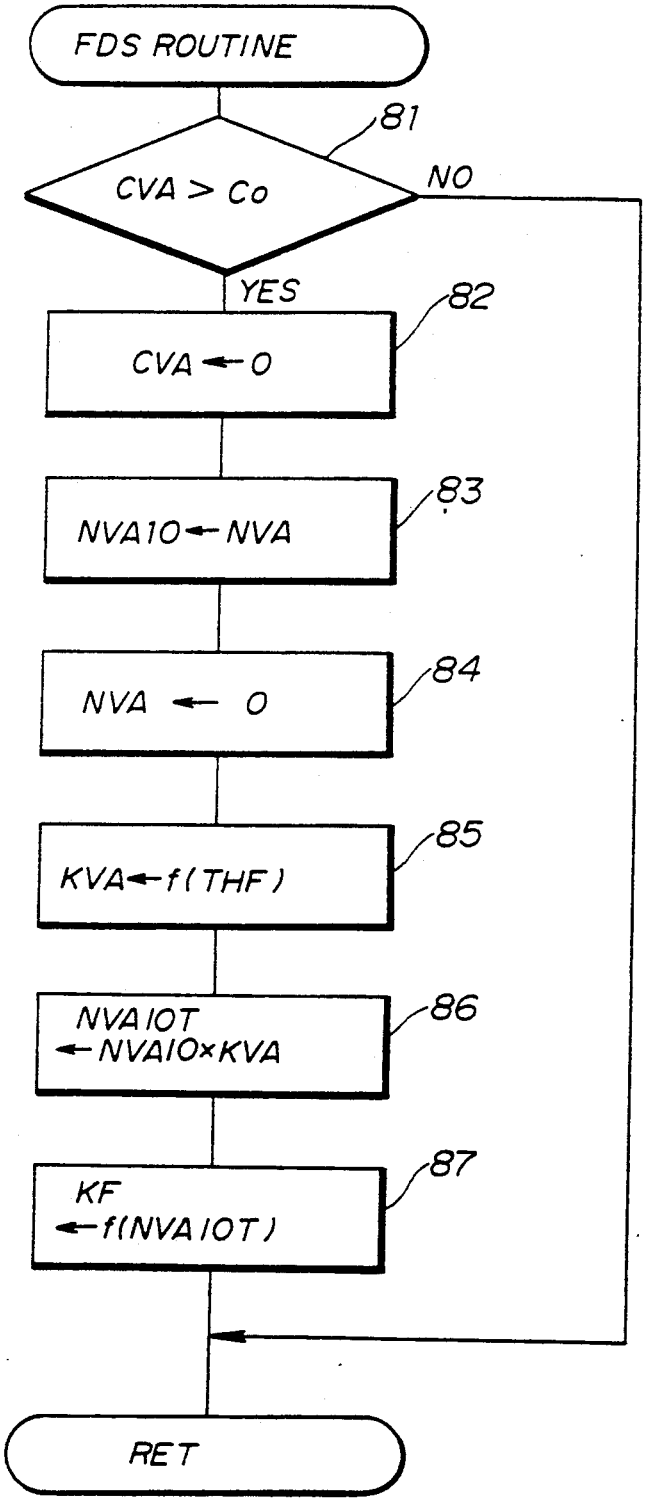
FIG. 4 is a flow chart for explaining the procedure of a fuel distillation sensing routine.

Next, a description will be given of the operation of the microcomputer 21 to obtain a fuel distillation characteristic of the fuel used, with reference to FIG. 4. FIG. 4 is a flow chart for explaining the operation of a fuel distillation sensing (FDS) routine which constitutes a part of a main routine. A step 81 makes a decision on whether a vapor flow measurement time CVA exceeds a reference value Co (e.g., Co = 10 seconds). Obviously, it is possible to preset this reference value Co to any suitable value. This vapor flow measurement time CVA is increased by one count each time a routine (not shown) for a time period of 4 ms is completed. If the CVA is smaller than the reference value Co, then this FDS routine is completed. If the CVA exceeds the Co, then a step 82 resets the CVA to zero. Thus, the following steps 82 to 87 are performed once per cycle indicated by by the reference value Co. When the reference value Co is preset to 10 seconds, the steps 82 to 87 are performed once every 10 seconds.

The microcomputer 21 comprises a vapor flow rate counter (not shown) which has a value NVA indicative of the flow rate of the fuel vapor, the value being increased by one increment due to occurrence of an external interrupt caused only when an output signal supplied from the vapor flow rate sensor 51 changes from a low level to a high level. In other words, the value NVA is increased by one count each time one revolution of the rotation part 50 of the vapor flow meter 49 is sensed by the vapor flow rate sensor 51. The step 83 sets the value CVA to a variable NVA10 and the step 84 resets the value CVA to zero. Accordingly, the variable NVA10 has a value indicating the number of revolutions of the rotation part 50 of the vapor flow meter 49 per unit time, this unit time being represented by the reference value Co (e.g., 10 seconds).

Next, the step 85 obtains the value of a fuel temperature correction factor KVA based on the fuel temperature signal THF indicative of a temperature of the fuel 35 within the fuel tank 17 which is supplied from the fuel temperature sensor 47. Generally, the fuel even with the same distillation characteristic has a greater amount of fuel evaporation when the fuel temperature is high than that when the fuel temperature is low. Therefore, in order to correct a difference in the amount of fuel evaporation due to a difference in the temperature of fuel, the fuel temperature correction factor KVA is so defined that the smaller value the KVA has the higher the fuel temperature becomes. The step 86 performs an arithmetic multiplication operation which is represented by a formula NVA10 × KVA, to determine the amount of fuel evaporation per unit time, which is set to a variable NVA10T. Thus, this NVA10T shows the measured quantity of fuel vapor per unit time NVA1O which is corrected by the fuel temperature correction factor KVA. Finally, the step 87 determines the fuel distillation factor KF based on the value of the NVA10T. In the present embodiment, the vapor flow measurement time of 10 seconds is used, and it is possible to make a change of fuel distillation factor during engine operation available to the microcomputer 21.

Figure 5:
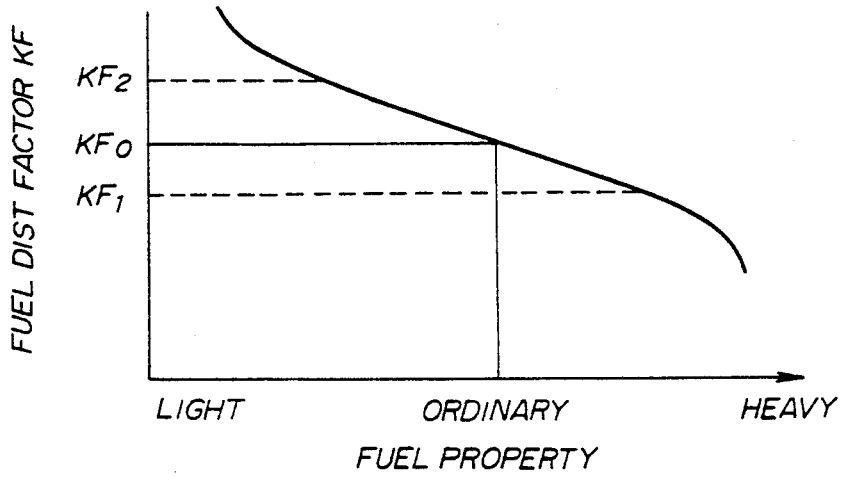
FIG. 5 is a chart showing the relationship between a fuel distillation characteristic and a fuel distillation factor.

FIG. 5 shows a relationship between the fuel property and the fuel distillation factor KF. As shown in FIG. 5, the fuel distillation factor KF is proportional to the amount of fuel evaporation per unit time. When the fuel distillation factor is equal to KF0, the fuel shows an ordinary distillation characteristic and it is neither the heavy type fuel nor the light type fuel. When the fuel shows a fuel distillation factor smaller than KF0, the fuel is the heavy type fuel containing components with a high boiling point in a greater percent than that of the remainder. When the fuel shows a fuel distillation factor greater than KF0, the fuel is the light type fuel containing components with a low boiling point in a greater percent.

Figure 6:
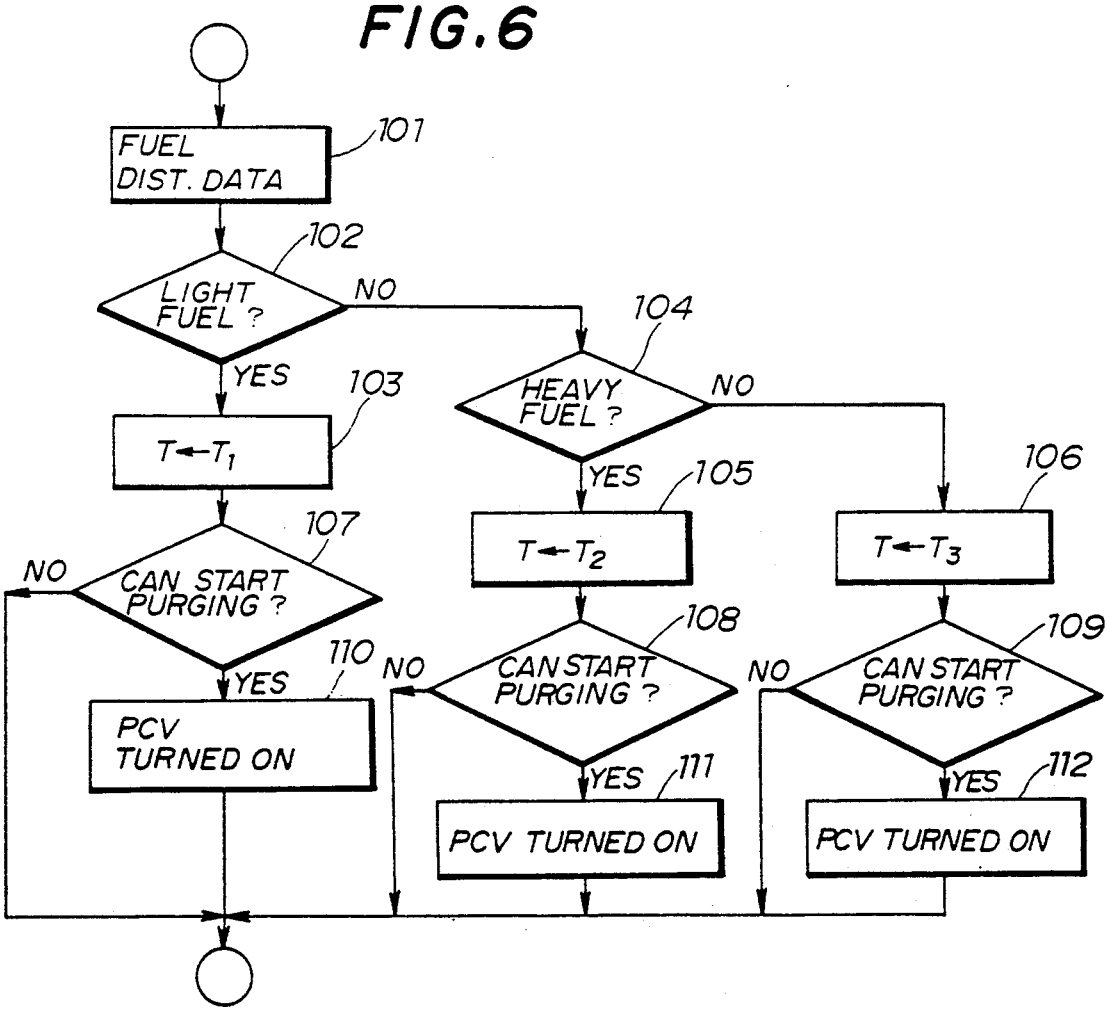
FIG. 6 is a flow chart for explaining the operation of the major parts of the evaporative fuel control system according to the present invention.

FIG. 6 is a flow chart for explaining the operation of the major parts of the evaporative fuel control system according to the present invention. First, a step 101 makes the microcomputer 21 read out a fuel distillation data (the fuel distillation factor KF) obtained through the fuel distillation sensing routine shown in FIG. 4. A step 102 makes a decision on whether the fuel used is a light type fuel. This decision is made, for example, by comparison of the fuel distillation factor KF with the predetermined reference value KF2 as shown in FIG. 5. When the fuel distillation factor KF is not smaller than the predetermined reference value KF2, the fuel is decided to be a light type fuel, and when the fuel distillation factor KF is smaller than the predetermined reference value KF2, the fuel is decided not to be a light type fuel.

If the fuel is decided to be a light type fuel in the step 102, then a step 103 sets the water temperature T for starting the fuel purging to a first temperature level T1 (e.g., T1=40 deg. C). On the other hand, if the fuel is decided not to be a light type fuel, then a step 104 makes a decision on whether the fuel is a heavy type fuel. This decision is made, for example, by comparison of the fuel distillation factor KF with the predetermined reference value KF1 which is smaller than the reference value KF0 shown in FIG. 5. When the fuel distillation factor KF is not greater than the KF1, the fuel is decided to be a heavy type fuel, and when the fuel distillation factor KF is greater than the KF1 the fuel is decided not to be a heavy type fuel. If the fuel is decided to a heavy type fuel ($KF \leqq KF1$ in the step 104, then a step 105 sets the water temperature T for starting the fuel purging to a second temperature level T2 ($T2>T1$, and e.g. T2=60 deg. C).

If the fuel is decided not to be a heavy type fuel ($KF1<KF<KF2$) in the step 104, then it is decided that the fuel used is not a small type fuel and not a heavy type fuel. Next, a step 106 sets the water temperature T for starting the the fuel purging to a third temperature level T3 ($T1<T3<T2$, and e.g., T3=50 deg. C).

After the water temperature T for starting the fuel purging is determined in any of the steps 103, 105 and 106, a decision on whether another conditions for starting the fuel purging are met is next checked in a step 107, 108 or 109. Such another conditions under which the fuel purging can be started without causing an operating problem include several matters which are, for example, whether the idle switch 26 is turned OFF, and whether the cooling water temperature THW is determined and it is not smaller than the water temperature T for starting the fuel purging determined in the step 103, 105 or 106 above. If such conditions for starting the fuel purging are met, then any of steps 110, 111 and 112 turns the purge control valve 52 ON so that the canister 11 starts operation of the fuel purging. If such conditions for starting the fuel purging are not met, then the fuel purging is not started and the above procedure shown in FIG. 6 is terminated.

As described in the foregoing, when using an ordinary fuel which is neither a light type fuel nor a heavy type fuel, the purge control valve 52 is placed at a closed position until the cooling water temperature during engine operation reaches the third temperature level T3 for starting the fuel purging which is substantially the same level as that of the conventional case, and when the cooling water temperature of the engine 32 exceeds the third temperature level T3 the purge control valve 52 is turned ON and placed at an open position so that the fuel purging to the intake system is started. When a light type fuel is used, the purge control valve 52 is turned from a closed position (OFF) to an open position (ON) when the cooling water temperature of the engine 32, after the operation is started, reaches the first temperature level T1 that is lower than the temperature level T3 ($T1<T3$). In the case of the light type fuel being used, the fuel is relatively easy to evaporate and combustion in the combustion chamber 33 is relatively stable, and much fuel vapor may be quickly adsorbed by the active carbon 11*a* in the canister 11. Accordingly, by advancing the time to start the fuel purging to the intake system, it is possible to reduce the amount of fuel vapor being stored in the canister 11, thereby improving driveability and eliminating undesired gasoline odor from the canister opening to atmosphere. On the other hand, when a heavy type fuel is used, the purge control valve 52 is placed from a closed position to an open position when the cooling water temperature of the engine, after the operation is started, reaches the second temperature level T2 that is higher than the temperature level T3 ($T3<T2$). This allows the time to start the fuel purging to be delayed to an later time than that in the conventional case, when the air fuel ratio of a mixture becomes stable. Therefore, the driveability at the time of the initial idling stage, which may often worsen in the conventional case, can improve remarkably.

Further, the present invention is not limited to the above described embodiments, and modifications and variations may be made without departing from the scope of the present invention. For example, the fuel distillation sensing part 17, which is used in the exhaust gas recirculation system of the present invention, may be any of several conventional apparatus. Among such conventional apparatus, there is a sensing apparatus which obtains a fuel distillation data by making use of a response speed change responsive to the change of fuel condition when an engine operating condition changes, as disclosed in Japanese Laid-Open Patent Application No. 63-66436. Also, among such conventional apparatus which may be used as the fuel distillation sensing part 17, there are several apparatus including a sensing apparatus which obtains a fuel distillation data based on a change of fuel temperature from before air and fuel are mixed together to that after the air/fuel mixture is obtained, as disclosed in Japanese Laid-Open Utility Model Application Nos. 62-59740 and 62-59742, a sensing apparatus which senses a specific gravity of fuel as disclosed in Japanese Laid-Open Patent Application No. 62-147036, a sensing apparatus which obtains a fuel distillation data from a reid vapor pressure (RVP) determined by a rise time for which a fuel temperature and fuel tank pressure increase and reach prescribed reference values, respectively, as disclosed in Japanese Laid-Open Utility Model Application No. 62-116144, and a conventional pressure sensing apparatus which senses a pressure within a fuel tank.

In addition, the valve 14 provided at an intermediate portion of the recirculation passage according to the present invention is not limited to the EGRV 47 which is shown in FIG. 2, but it is possible to use a vacuum switching valve (VSV) provided together with an exhaust gas recirculation (EGR) valve, the vacuum switching valve being controlled by the microcomputer 21 to turn the EGR valve ON when a vacuum pressure from an intake manifold is applied to the EGR valve. Further, it is possible to use the correction procedures as described with reference to FIGS. 9 and 11, in addition to the use of the above modified embodiment.

What is claimed is:

1. An evaporative fuel control system comprising:

a canister for storing a fuel vapor supplied from a fuel tank;

a purge passage provided between said canister and an intake manifold of an internal combustion engine;

a valve provided at an intermediate portion of the purge passage for regulating a flow of a fuel vapor from the canister into the intake manifold in accordance with an operating condition of the internal combustion engine;

engine temperature sensing means for sensing an engine temperature of the internal combustion engine;

fuel distillation sensing means for sensing a fuel distillation characteristic of a fuel within the fuel tank;

first valve control means, responsive to the engine temperature supplied form the engine temperature sensing means, for adjusting a valve position of the valve to control the flow of fuel vapor from the canister to the intake manifold; and second valve control means, responsive to the fuel distillation characteristic supplied from the fuel distillation sensing means, for adjusting a time of turning the valve ON at which a supply of the fuel vapor form the valve to the intake manifold is started, wherein the second valve control means allows the valve to be turned ON when the engine temperature signal is higher than a predetermined engine temperature level, the engine temperature level being changed depending on the fuel distillation characteristic supplied form the fuel distillation sensing means.

2. The evaporative fuel control system as claimed in claim 1, wherein an engine temperature sensor provided on the internal combustion engine constitutes the engine temperature sensing means and a part of a microcomputer constitutes the first valve control means, said part of the microcomputer serving to place the valve at a closed position stopping the flow of the fuel vapor into the intake manifold when the engine temperature indicated by a water temperature signal supplied from the engine temperature sensor to the microcomputer is not higher than a predetermined engine temperature level, and immediately after the engine temperature exceeds the predetermined engine temperature level the valve being placed suitably at an open position allowing the flow of the fuel vapor into the intake manifold.

3. The evaporative fuel control system as claimed in claim 2, wherein a part of the microcomputer constituting the second valve control means, responsive to a fuel distillation characteristic signal supplied from the vapor flow rate sensor to the microcomputer, sets the predetermined engine temperature level to a first level when the fuel is found to be a light type fuel, and when the fuel is found to be a heavy type fuel the predetermined engine temperature level being changed to a second level retarding appropriately the time of turning the valve ON relative to that when the light type fuel is used, said second level of the engine temperature being higher than the first level, and, when the fuel is found to be neither the light type fuel nor the heavy type fuel, the predetermined engine temperature level being set to a third level that is above the first level and below the second level.

4. The evaporative fuel control system as claimed in claim 2, wherein a vapor flow meter and a vapor flow rate sensor constitute the fuel distillation sensing means and a part of the microcomputer constitutes the second valve control means, the vapor flow meter provided in a passage between the fuel tank and the canister for measuring a flow rate of the fuel vapor from the fuel tank to the canister, the vapor flow rate sensor provided on the vapor flow meter, said part of the microcomputer changing the predetermined engine temperature level depending on the fuel distillation characteristic indicated by a fuel distillation characteristic signal supplied from the vapor flow rate sensor to the microcomputer, said fuel distillation characteristic being determined primarily from a flow rate of said fuel vapor measured by the vapor flow meter, the measured flow rate being multiplied by a fuel temperature correction factor which is predetermined depending on the fuel temperature from the engine temperature sensing means.

5. The evaporative fuel control system as claimed in claim 3, wherein the microcomputer comprises a vapor flow rate counter which has a value indicative of the flow rate of the fuel vapor, the value being increased by one increment each time an output signal supplied from the vapor flow rate sensor changes from a low level to a high level, the vapor flow rate sensor performing measurement of the amount of the fuel vapor per unit time, said unit time being adjustable to an arbitrary value.

6. The evaporative fuel control system as claimed in claim 1, wherein the fuel within the fuel tank is grouped into three types including a light type fuel, a heavy type fuel and an ordinary fuel, depending on the fuel distillation factor supplied from the fuel distillation sensing means, said fuel distillation factor being compared with a first reference value, and further compared with a second reference value that is smaller than the first reference value, the fuel being determined to be the light type fuel when the fuel distillation factor is greater than the first reference value, and when the fuel distillation factor is smaller than the second reference value the fuel being determined to be the heavy type fuel, and further the fuel being determined to be the ordinary fuel when the fuel distillation factor is not greater than the first reference value and is not smaller than the second reference value.

7. The system as claimed in claim 1, wherein said fuel within the fuel tank is gasoline and said sensing means detects a fuel distillation characteristic of the gasoline within the fuel tank.

8. The system as claimed in claim 1, wherein the engine temperature sensed is a cooling water temperature.

* * * * *

UNITED STATES PATENT AND TRADEMARK OFFICE

CERTIFICATE OF CORRECTION

PATENT NO. : 5,111,796

DATED : May 12, 1992

INVENTOR(S) : Tamotu OGITA

It is certified that error appears in the above-identified patent and that said Letters Patent is hereby corrected as shown below:

Column 1, line 25, after "operation" insert a comma.

Column 1, line 26, after "tures" insert a comma.

Column 5, line 28, change "!7" to --17--.

Column 6, line 3, delete one "the".

Column 6, lines 43 and 44, continue on "the canister" on line 44 after "tank 17 to" on line 43. Do not start new paragraph.

Column 8, line 17, delete one "by".

Column 9, line 45, delete one "the".

Column 9, line 49, change "another" to --other--.

Column 9, line 51, change "another" to --other--.

Column 10, line 29, change "an" to --a--.

UNITED STATES PATENT AND TRADEMARK OFFICE

CERTIFICATE OF CORRECTION

PATENT NO. : 5,111,796

DATED : May 12, 1992

INVENTOR(S) : Tamotu OGITA

It is certified that error appears in the above-identified patent and that said Letters Patent is hereby corrected as shown below:

Column 11, line 27, change "form" to --from--.

Column 11, line 35, change "form" to --from--.

Column 11, line 41, change "form" to --from--.

Signed and Sealed this

Fifth Day of October, 1993

Bruce Lehman

*Attest:*

BRUCE LEHMAN

*Attesting Officer*

*Commissioner of Patents and Trademarks*